US008668063B2

(12) United States Patent
Wang et al.

(10) Patent No.: US 8,668,063 B2
(45) Date of Patent: Mar. 11, 2014

(54) DAMPING SHAFT MECHANISM

(75) Inventors: XiangJi Wang, Xiamen (CN); WenCheng Chen, Xiamen (CN)

(73) Assignee: XiangJi Wang, Xiamen (CN)

( * ) Notice: Subject to any disclaimer, the term of this patent is extended or adjusted under 35 U.S.C. 154(b) by 64 days.

(21) Appl. No.: 13/529,685

(22) Filed: Jun. 21, 2012

(65) Prior Publication Data

US 2013/0043100 A1 Feb. 21, 2013

(30) Foreign Application Priority Data

Aug. 17, 2011 (CN) ..... 2011 1 0237200

(51) Int. Cl.
*F16F 9/14* (2006.01)

(52) U.S. Cl.
USPC ..... 188/322.22; 4/236; 4/248

(58) Field of Classification Search
USPC ..... 188/290, 296, 310, 322.15, 322.22; 4/236, 248
See application file for complete search history.

(56) References Cited

U.S. PATENT DOCUMENTS 7,322,450 B2 * 1/2008 Orita ..... 188/296
8,167,100 B2 * 5/2012 Chen ..... 188/290
8,439,172 B2 * 5/2013 Lee ..... 188/290

* cited by examiner

*Primary Examiner* — Christopher Schwartz
(74) *Attorney, Agent, or Firm* — Rabin & Berdo, P.C.

(57) ABSTRACT

A damping shaft mechanism has a spiral shaft, spiral guide bush, a shell and blade. An external spiral structure is arranged at one end of the spiral shaft, and its core has a cone segment. An internal spiral structure is arranged in the spiral guide bush, which cooperates rotationally with the external spiral structure so that it can move along the axis relative to the spiral shaft when the spiral shaft is rotating. The two cavities change size by moving the spiral guide bush driven by the spiral shaft in the shell, and the taper on the spiral shaft makes the fit clearance between the spiral shaft and the spiral guide bush changed from maximum to minimum gradually in the damping process, so that the oil-flowing section between the two cavities changes from big to small.

12 Claims, 6 Drawing Sheets

DAMPING SHAFT MECHANISM

FIELD OF THE INVENTION

The present invention relates to a cover shaft mechanism, more particularly to a damping shaft mechanism that can achieve easy opening and damping of the cover.

BACKGROUND OF THE INVENTION

People often cover the cover to the main body of the toilet conveniently to reduce the smell of the toilet, as a result, the frequency of opening and closing the cover is high, and the key is the joining component between the cover and the main body of the toilet, of which the stability and reliability are highly concerned. The joint of the cover and the main body of the toilet is directly achieved by some simple rotating joint at the prior art, and there is no resistance to prevent the cover hitting the main body of the toilet heavily when people lay the cover down, so that the rotating joint between the cover and the main body of the toilet and the cover or the main body of the toilet are easy to be damaged. To solve the problem above, many shaft mechanisms are present to achieve damping, of which one important characteristic is to get the effect of one-way valve by using blades: the blades block the passage of the damping oil to form the slow flowing effect of the cover when the pivot rotates ahead one direction, the blades open the passage of the damping oil to form the fast flowing effect of the cover when de pivot rotates ahead another direction. But there are several structural defects of the above mechanisms such as complication of the working technique, limitation of the structure and the intensity, shortage of the service life, and more special, the damping of the cover during the whole falling process is not convenient to use.

SUMMARY OF THE INVENTION

The object of the present invention is to overcome the defects at the prior art and to offer a damping shaft mechanism of the cover. The size change of the two cavities is achieved by the moving of the spiral guide bush driven by the spiral shaft in the shell, as a result, the cover can fall fast during the incipient stage of the damping, and then gradually turns to slowly by using the cone segment and the straight segment of the spiral shaft. It is very convenient that the starting angle of the damping can be controlled by adjusting the straight segment and the cone segment of the spiral shaft.

A damping shaft mechanism comprises spiral shaft, spiral guide bush, shell and blades; an external spiral structure is arranged around the spiral shaft; the core of the spiral shaft comprises a cone segment; an internal spiral structure is accordingly arranged in the spiral guide bush; a cavity is arranged in the shell, the end of the spiral shaft that is rotationally connected with the spiral guide bush is in the cavity, and the cavity is sealed; the sealed cavity is filled with damping oil; the said sealed cavity is divided into two cavities by the spiral guide bush; the cone segment of the spiral shaft contracts gradually from one end to another end, so that the fit clearance between the spiral shaft and the spiral guide bush is changed from big to small during the damping process, and the flowing speed of the damping oil in the two cavities is changed from fast to slow.

The size change of the two cavities is achieved by the moving of the spiral guide bush driven by the spiral shaft in the shell, and the taper on the spiral shaft makes the fit clearance between the spiral shaft and the spiral guide bush changed from maximum to minimum gradually in the damping process, so that the oil-flowing section between the two cavities changes from big to small, as a result, the cover can fall fast during the incipient stage of the damping, and then gradually turns to slowly. It is very convenient that the starting angle of the damping can be controlled by adjusting the straight segment and the cone segment of the spiral shaft.

The beneficial effects from the present invention are: the damping shaft mechanism comprises spiral shaft, spiral guide bush, shell and blade; an external spiral structure is arranged at one end of the spiral shaft, and the core of the external spiral structure comprises a cone segment; an internal spiral structure is arranged in the spiral guide bush which is rotationally cooperated with the external spiral structure of the spiral shaft so that it can move along the axis relative to the spiral shaft when the spiral shaft is rotating. The size change of the two cavities is achieved by the moving of the spiral guide bush driven by the spiral shaft in the shell, and the taper on the spiral shaft makes the fit clearance between the spiral shaft and the spiral guide bush changed from maximum to minimum gradually in the damping process, so that the oil-flowing section between the two cavities changes from big to small, as a result, the cover can fall fast during the incipient stage of the damping, and then gradually turns to slowly. It is very convenient that the starting angle of the damping can be controlled by adjusting the straight segment and the cone segment of the spiral shaft. The easy opening and the damping are achieved through such method: the motion position of the spiral guide bush changes the fit clearance between the spiral guide bush and the spiral shaft, and then changes the flow rate of the damping oil in the cavity so that the rate of the mechanism's damping is changed, furthermore, first quick back damping process is fit to the people's using characteristics, and the structure of the present invention is simple and the assembly is easy.

Further detailed description is present below with reference of the drawings and the embodiments; but the damping shaft mechanism in the present invention is not restricted to the embodiments.

DESCRIPTION OF THE PREFERRED EMBODIMENTS

With the following description of the drawings and specific embodiments, the invention shall be further described in details.

Figure 1:
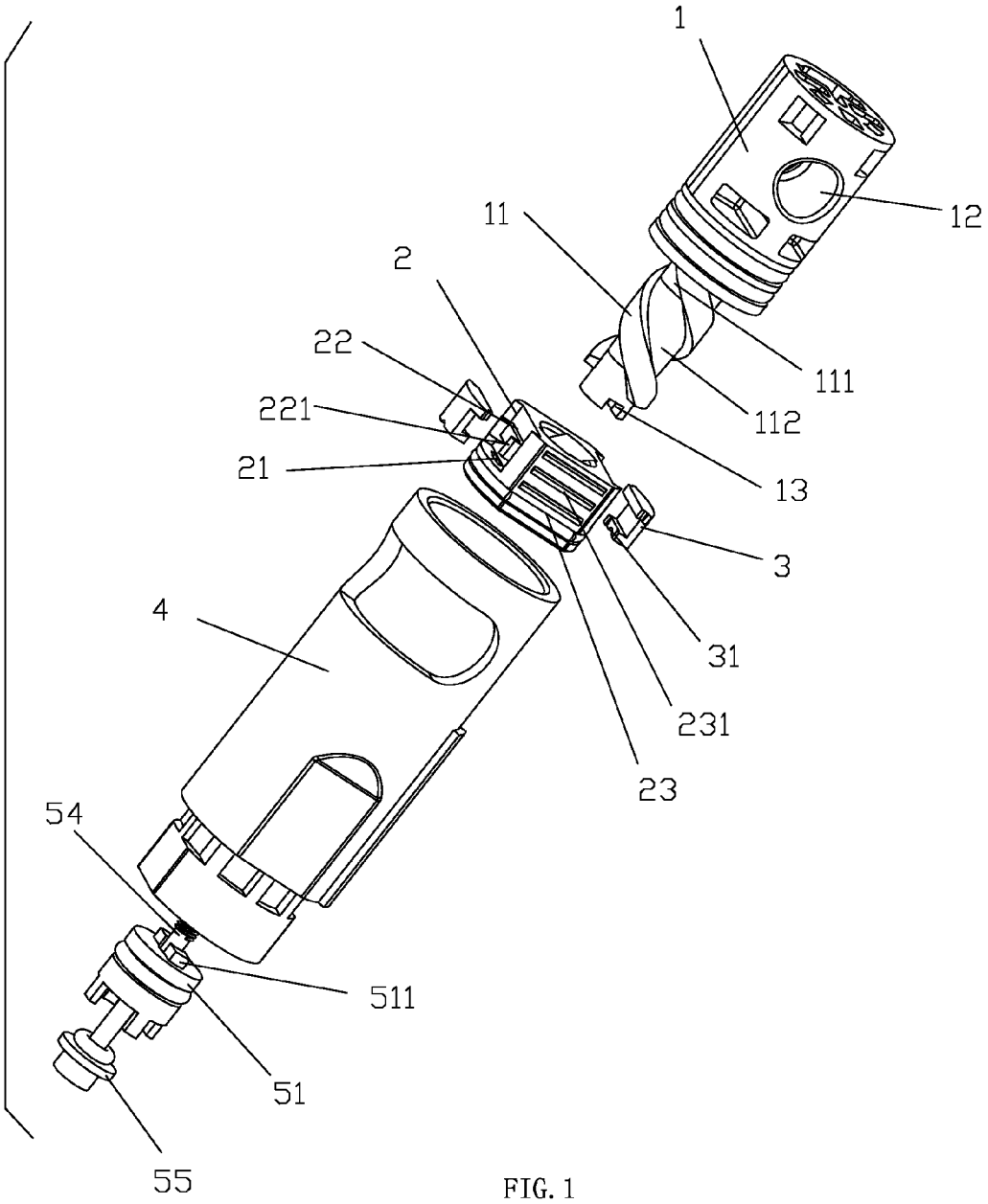
FIG. 1 shows the explosive view of the present invention.
Figure 3:
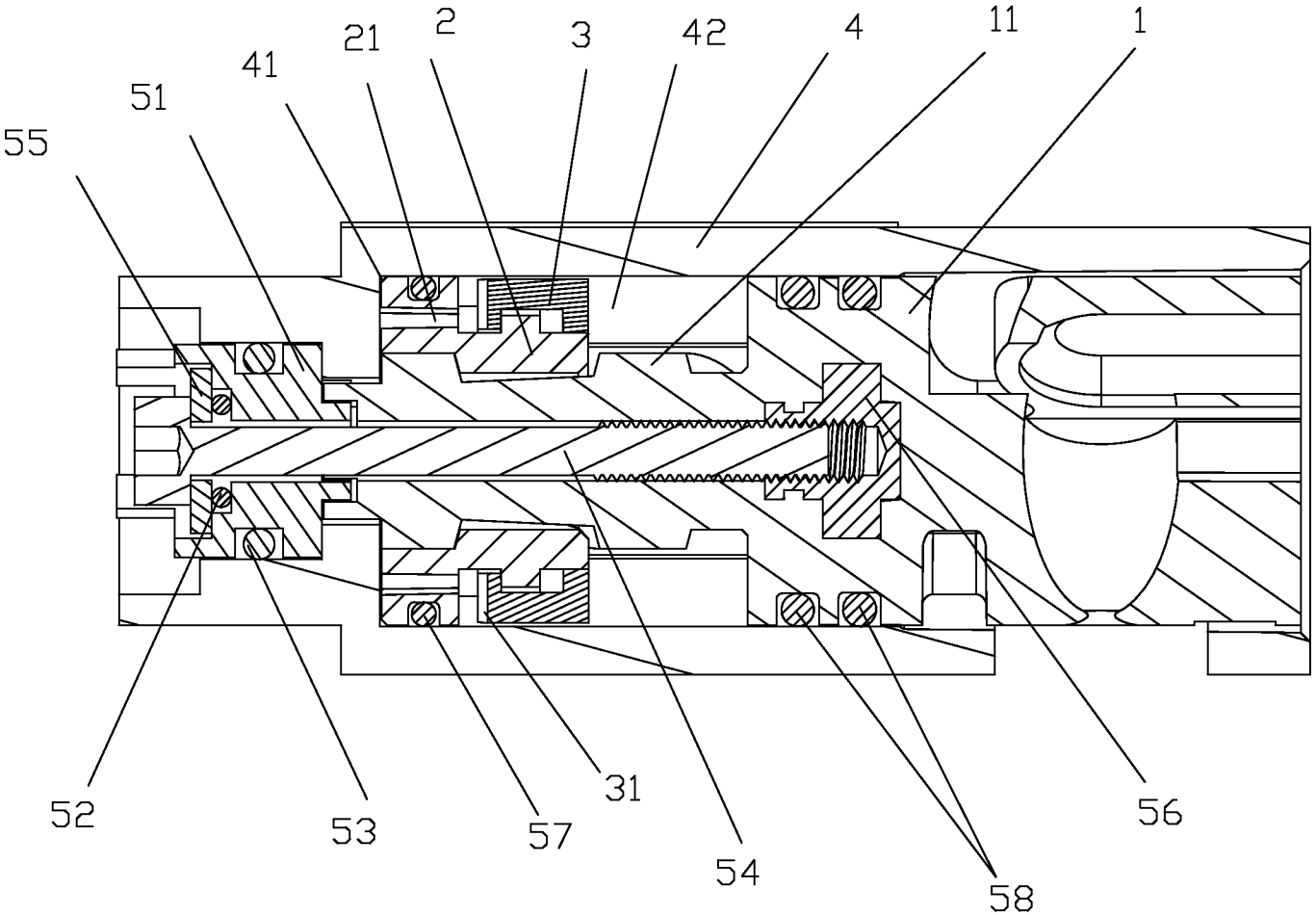
FIG. 3 shows the sectional view of the present invention when it opens completely.

With the reference to FIG. 1 and FIG. 3, a damping shaft mechanism of the present invention comprises spiral shaft 1, spiral guide bush 2, shell 4 and blade 3; an external spiral structure 11 is arranged at one end of the spiral shaft 1, the end of the said external spiral structure 11 includes a straight segment 111 at the inner segment and a cone segment 112 in the outer segment, and the cone segment 112 contracts gradually from inside to outside; an internal spiral structure is arranged in the spiral guide bush 2, the spiral guide bush 2 is rotationally cooperated at the external spiral structure 11 of the spiral shaft, so that the spiral guide bush 2 can move along the axis relative to the spiral shaft when the spiral shaft is rotating; there is a cavity in the shell 4, the first opening arranged at the one end of the shell connects with the cavity, the end that is rotationally connected with the spiral guide bush 2 of the spiral shaft 1 is inserted to the cavity through the first opening so that the cavity is sealed; the sealed cavity is filled with damping oil, the outer wall of the spiral guide bush 2 touches and leans the cavity wall of the shell 4's cavity and cannot rotate relative to the shell 4 along the circumferential direction through the mutual limiting structure; the said sealed cavity is divided into two cavities by the spiral guide bush 2, namely the cavity 41 and the cavity 42; the through hole 21 is formed in the spiral guide bush, which makes the said two cavities connected, the blade 3 is actively installed at one side of the through hole 21 so that it can get close to and cover, or leave the said through hole during the moving process of the spiral guide bush.

Among which,

The other end of the said spiral shaft is connected to the fixed support directly or indirectly; a ready-packaged hole 12 is arranged at the other end of the said spiral shaft.

A guide channel 22 that can make the blade 3 move along the axis of the spiral guide bush 2 is arranged at one side of the through hole of the said spiral guide bush 2; the blade 3 is actively clamped in the guide channel 22.

The said spiral guide bush 2 is cooperated in the cavity of the said shell 4, two first rotation-stopping surfaces are arranged in cavity of the said shell 4, two second rotation-stopping surfaces 23 are arranged on the said spiral guide bush, and the two second rotation-stopping surfaces 23 contact and lean the two first rotation-stopping surfaces of the shell 4 respectively, so that the said spiral guide bush 2 cannot rotate along the circumferential direction relative to the said shell.

The damping shaft mechanism also further comprises a limiting component, a second opening that is communicated with the cavity is formed at the other end of the said shell 4, the limiting component is cooperated at the second opening so that the second opening is sealed, and the said limiting component is clamped with one end edge of the said spiral shaft 1, so that one end of the said spiral shaft 1 is rotationally limited in the cavity of the said shell 4.

The said limiting component comprises a end cover 51, the first sealing ring 52, the second sealing ring 53, a screw 54 and steel gasket 55; a channel is arranged along the direction of the end cover 51's axis, and a embossment 511 is arranged at one end face of the end cover 51; a install slot is opened along the axis of the spiral shaft 1 from one end to another; a clamping slot 13 is arranged at the one end of the spiral shaft; the said end cover 51 can rotationally cooperate with the said shell 4 at the second opening, and the embossment 511 cooperates with the clamping slot 13; a iron inlay 56 is installed in the bottom of the install slot of the said spiral shaft, the screw 54 goes through the steel gasket 55, the first sealing ring 52, the channel of the end cover 51 and the install slot of the said spiral shaft, and cooperate with the iron inlay 56 by lock joint; the second sealing ring 53 that is against to the second opening of the said shell 4 is sleeved on the wall surface of the end cover 51.

The damping shaft mechanism also further comprises a third sealing ring 57 that is around the outer wall surface of the said spiral guide bush 2 and is against the wall surface of the said shell 4's cavity to isolate the two cavities; the drainage slot 31 is arranged on the blade 3.

There are two said through holes 21, The two said through holes 21 are symmetrically arranged on the spiral guide bush 2; a clamping strip 221 is arranged in the guide channel 22 at one side of the through hole 21; there are two said blades 3, a chute is in the inner wall of each the said blade 3; the said two blades are limited to the guide channel 22 of the said spiral shaft by the actively cooperating between the chute and the corresponding clamping strip 221.

The damping shaft mechanism also further comprises two fourth sealing rings 58 that are respectively around the rod body of the said spiral shaft 1 and is against the said shell 4's wall surface that is close to the first opening.

Several fillets 231 are arranged on the two second rotation-stopping surface 23 of the said spiral shaft respectively, which touch and lean the two first rotation-stopping surface of the said shell.

Figure 2:
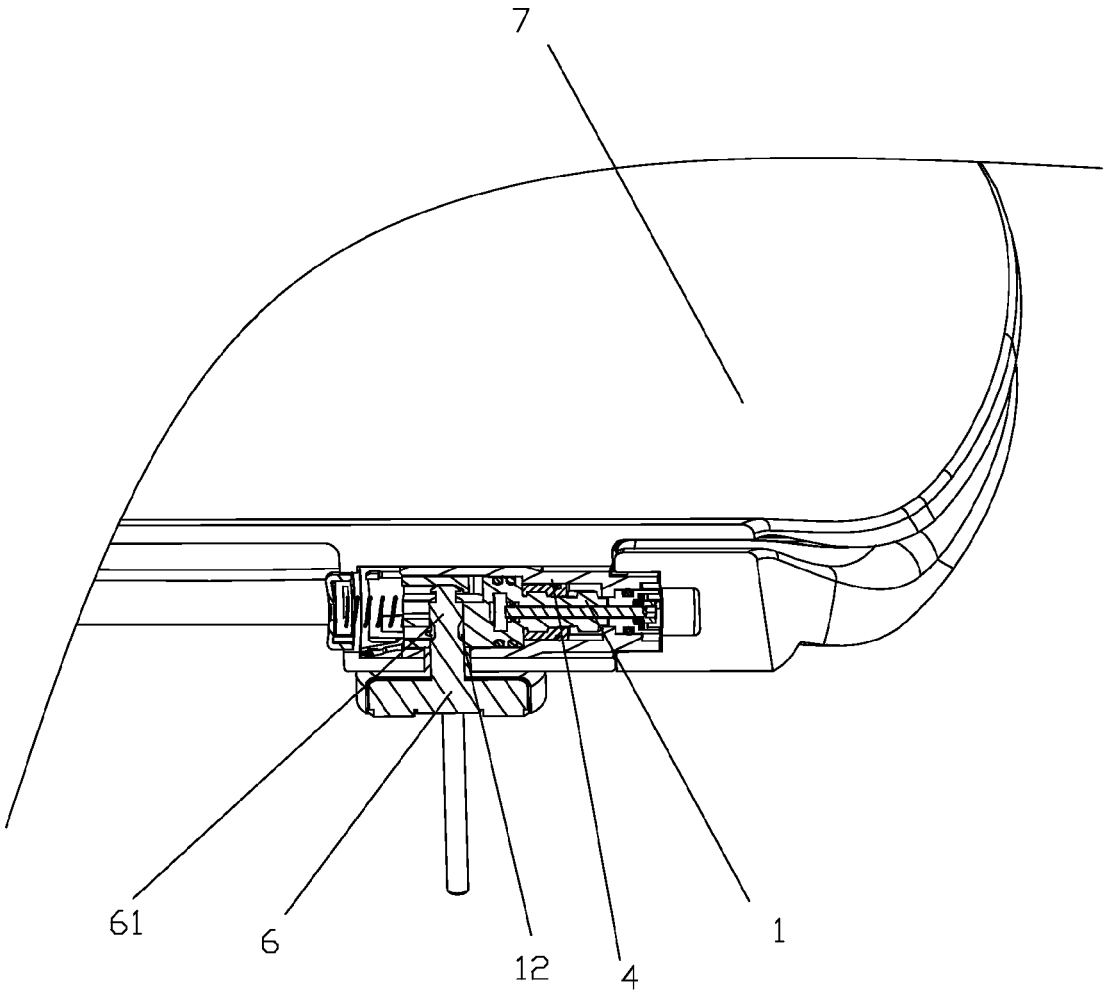
FIG. 2 shows the local structure view of the present invention after installation.

With the reference to FIG. 2, the damping shaft mechanism in the present invention is present, after the assembly of the spiral shaft 1, the spiral guide bush 2, the blade 3, the shell 4 and other components, the shell 4 is sleeved and clamped in the axis guide, the insert pin 61 of the ready-packaged support 6 installed on the toilet body is inserted into the ready-packaged hole 12 of the spiral shaft 1, when toilet cover is falling or upturning, the shell 4 and the spiral guide bush 2 will be driven to rotate relative to the helical spile 1, and the spiral guide bush does the reciprocating motion in the shell 4 along the direction of the axis of the shell 4.

Figure 4:
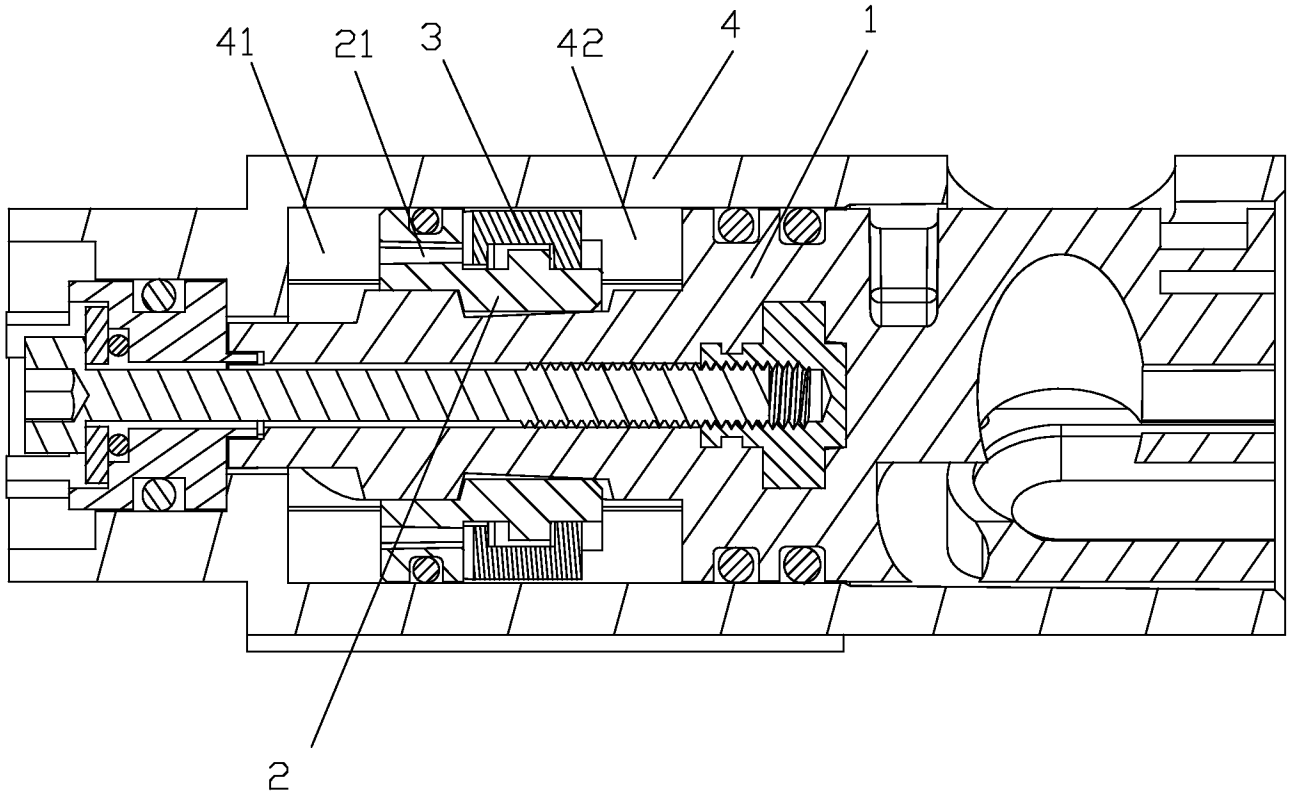
FIG. 4 shows the sectional view of the present invention during the falling process.

With reference to FIG. 3 and FIG. 4, when the toilet cover 7 is opened completely, namely before the cover 7 starting to fall, the spiral guide bush 2 is cooperated at one end edge of the spiral shaft 1, namely at the small end of the cone segment 112, at the same time, the clearance between the spiral guide bush 2 and the spiral shaft 1 is the biggest. When the cover 7 starts to fall, the spiral guide bush 2 moves to the other end of the spiral shaft 1 relative to the spiral shaft 1. The damping oil in the cavity 42 can flow to the cavity 41 for the cavity is full of damping oil, the damping oil can swimmingly flow from the cavity 42 to the cavity 41 for the biggest clearance between the spiral guide bush 2 and the spiral shaft 1, the spiral guide bush 2 moves to the big end of the cone segment 122 gradually along with the moving of the spiral guide bush 2, so that the clearance between the spiral guide bush 2 and the spiral shaft 1 is getting smaller, and then the flow rate of the damping oil flowing from the cavity 42 to the cavity 41 is getting slower, and the damping effect is getting bigger gradually, the clearance between the spiral guide bush 2 and the spiral shaft 1 is the smallest when the spiral guide bush moves to the straight segment 111, and the biggest damping effect is achieved, the process goes on until the cover 7 falling down completely. The blade 3 is driven to one end of the spiral shaft in the guide channel 22 by the oil pressure in the cavity 42 during the process, namely the blade 3 resist to the through hole, the damping oil in the cavity 42 cannot flow to the cavity 41 swimmingly through the through hole 21, so that the better damping effect is provided during the process and the damping of the cover 7 is achieved.

Figure 5:
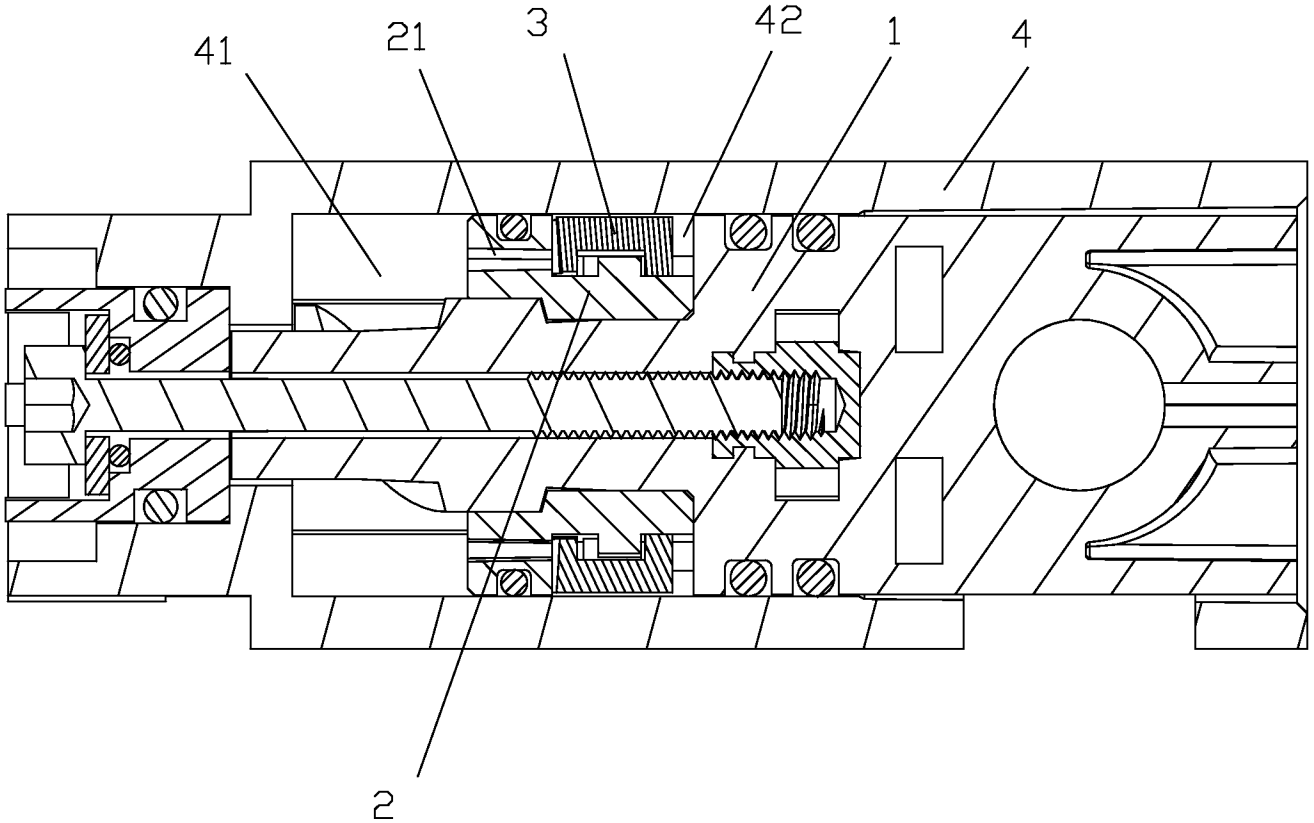
FIG. 5 shows the sectional view of the present invention when it falls completely.
Figure 6:
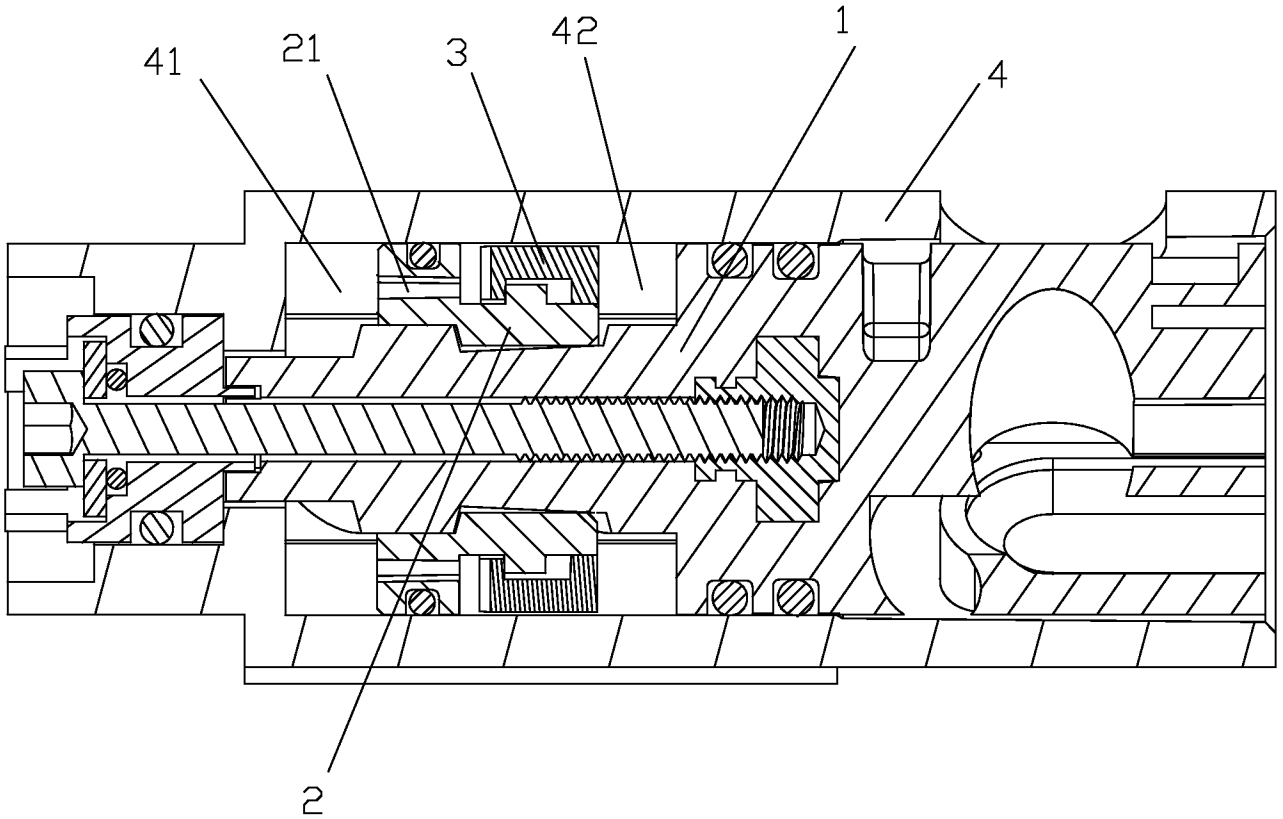
FIG. 6 shows the sectional view of the present invention during the upturning process.

With reference to FIG. 5 and FIG. 6, when the toilet cover 7 closes completely, the spiral guide bush 2 is cooperated at the other end of the spiral shaft 1, namely at the straight segment 111, at the same time, the clearance between the spiral guide bush 2 and the spiral shaft 1 is the smallest. When the cover 7 starts to upturn, although the clearance between the spiral guide bush 2 and the spiral shaft 1 is the smallest, and the flowing of the damping oil from the cavity 41 to the cavity 42 is affected, the blade 3 is driven to the another end of the spiral shaft in the guide channel 22 by the oil pressure in the cavity 41 during the process, namely the blade 3 is pushed away from the through hole, and the damping oil in the cavity 41 can flow to the cavity 42 swimmingly through the through hole 21. The spiral guide bush 2 keeps moving to one end of the spiral shaft 1, namely the spiral guide bush 2 moves to the small end of the cone segment 112 gradually, so that the clearance between the spiral guide bush 2 and the spiral shaft 1 is getting bigger, and the damping oil in the cavity 41 can flow to the cavity 42 more swimmingly, and the flow rate is getting faster, and damping effect that is getting smaller gradually is provided, the process goes on until the cover is completely open. The fast opening of the cover 7, namely the easy-opening process is achieved.

The starting angle of the damping can be controlled by adjusting the cone segment of the spiral shaft, namely the cone segment 122, and the straight segment of the spiral shaft, namely the straight segment 111.

The invention has been described with reference to the preferred embodiment mentioned above; therefore it cannot limit the reference implementation of the invention. It is obvious to a person skilled in the art that structural modification and changes can be carried out without leaving the scope of the claims hereinafter and the description above.

What is claimed is:

1. A damping shaft mechanism, comprises a spiral shaft, a spiral guide bush, a shell; an external spiral structure is arranged around the spiral shaft; the core of the spiral shaft comprises a cone segment; an internal spiral structure is accordingly arranged in the spiral guide bush; a cavity is formed in the shell, the end of the spiral shaft which is rotationally connected with the spiral guide bush is in the cavity, and the cavity is sealed; the sealed cavity is filled with damping oil; the said sealed cavity is divided into two cavities by the spiral guide bush; the cone segment of the spiral shaft contracts gradually from one end to another end, so that the fit clearance between the spiral shaft and the spiral guide bush is changed from big to small during the damping process, and the flowing speed of the damping oil in the two cavities is changed from fast to slow.

2. The damping shaft mechanism according to claim 1, wherein the other end of the said spiral shaft is connected to the fixed support directly or indirectly.

3. The damping shaft mechanism according to claim 2, wherein, is paired arranged, the spiral shaft at one side is connected and synchronously rotated with toilet cover, and the spiral shaft at another side is connected and synchronously rotated with toilet seat.

4. The damping shaft mechanism according to claim 1, wherein a through hole which makes the said two cavities communicated is formed along the axial direction of the spiral guide bush, and the blades are actively mounted at the front of the through hole, the blades leave the through hole when the spiral guide bush is moved to one side, so that the through hole is open; the blades cover the through hole when the spiral guide bush is moved to another side.

5. The damping shaft mechanism according to claim 4, wherein a guide channel that can make the blade move along the axis of the spiral guide bush is arranged at one side of the through hole of the said spiral guide bush, the blade is actively clamped in the guide channel.

6. The damping shaft mechanism according to claim 4, wherein, is paired arranged, the spiral shaft at one side is connected and synchronously rotated with toilet cover, and the spiral shaft at another side is connected and synchronously rotated with toilet seat.

7. The damping shaft mechanism according to claim 1, wherein said spiral guide bush is cooperated in the cavity of the said shell, two first rotation-stopping surfaces are arranged in the cavity of the said shell, two second rotation-stopping surfaces are arranged on the said spiral guide bush, and the two second rotation-stopping surfaces contact and lean on the two first rotation-stopping surfaces respectively, so that the said spiral guide bush cannot rotate along the circumferential direction relative to the said shell.

8. The damping shaft mechanism according to claim 1, wherein, also further comprises a limiting component, a second opening that is communicated with the cavity of the shell is arranged at the other end of the shell, the limiting component is cooperated at the second opening so that the second opening is sealed.

9. The damping shaft mechanism according to claim 1, wherein, also further comprises a third sealing ring that is sleeved around the outer wall surface of the said spiral guide bush, and the third sealing ring is against the wall surface of the cavity of the shell, so that the two cavities are isolated.

10. The damping shaft mechanism according to claim 1, wherein, further comprises two forth sealing rings, the two forth sealing rings are respectively sleeved around the rod body of the spiral shaft, and is against the wall surface of the cavity which is close to the first opening to get a seal.

11. The damping shaft mechanism according to claim 1, wherein, further, the starting angle of the damping is controlled by adjusting the length of the straight segment and the cone segment of the spiral shaft.

12. The damping shaft mechanism according to claim 1, wherein, is paired arranged, the spiral shaft at one side is connected and synchronously rotated with toilet cover, and the spiral shaft at another side is connected and synchronously rotated with toilet seat.

* * * * *